US009381423B2

(12) United States Patent
McCord

(10) Patent No.: US 9,381,423 B2
(45) Date of Patent: Jul. 5, 2016

(54) METHOD AND APPARATUS FOR GAME PLAY INVOLVING PUZZLES WITH AUTOCORRECT-RELATED OBFUSCATION

(71) Applicant: ME McCord, LLC, Ballwin, MO (US)

(72) Inventor: Mary Eunice McCord, Ballwin, MO (US)

(73) Assignee: ME McCord, LLC, Ballwin, MO (US)

( * ) Notice: Subject to any disclaimer, the term of this patent is extended or adjusted under 35 U.S.C. 154(b) by 179 days.

(21) Appl. No.: 13/795,795

(22) Filed: Mar. 12, 2013

(65) Prior Publication Data

US 2014/0221066 A1 Aug. 7, 2014

Related U.S. Application Data

(60) Provisional application No. 61/762,111, filed on Feb. 7, 2013.

(51) Int. Cl.
*A63F 9/24* (2006.01)
*A63F 9/18* (2006.01)

(52) U.S. Cl.
CPC ..... *A63F 9/183* (2013.01)

(58) Field of Classification Search
USPC ..... 463/9, 16–25, 30–42
See application file for complete search history.

(56) References Cited

U.S. PATENT DOCUMENTS 6,340,159 B1 * 1/2002 Giangrante ..... 273/272
2011/0230246 A1 * 9/2011 Brook et al. ..... 463/9
2012/0289324 A1 * 11/2012 Bancel et al. ..... 463/26
2013/0079077 A1 * 3/2013 Stegall ..... 463/9
2013/0079082 A1 * 3/2013 Bancel et al. ..... 463/9
2013/0260849 A1 * 10/2013 Cahill et al. ..... 463/9

OTHER PUBLICATIONS

WordsWithFriends wiki NPL release date Jul. 2009.*

"Damn You Auto Correct Board Game", http://www.calendars.com/Go!-Games/Damn-You-Auto-Corrrect-Board-Game/prod2013000, downloaded on Jan. 7, 2013, 2 pages.

"Looking for the Perfect Gift? Go! Calendars, Games & Toys and Calendars.com Recommends Unique Gifts for the Hard-to-Buy-For Person", http://www.cnbc.com/id/100297582/Looking_for_the_Perfect_Gift_Go_Calenders_Games, Austin, Texas, Dec. 10, 2012, downloaded on Jan. 7, 2013, 3 pages.

Trademark Electronic Search System (TESS), "Damn You Autocorrect", http://tess2.uspto.gov/bin/showfield?f=doc&state=4008:4vnn7r2.1, downloaded on Jan. 7, 2013, 2 pages.

* cited by examiner

*Primary Examiner* — Masud Ahmed
(74) *Attorney, Agent, or Firm* — Thompson Coburn LLP

(57) ABSTRACT

New and unusual games are described herein that are engaging and fun and can leverage well-known text autocorrection concepts to present puzzles for solution to users that effectively employ autocorrection in reverse. Such a puzzle can comprise a puzzle character string, the puzzle character string comprising one or more obfuscated words, wherein the one or more obfuscated words are configured to be de-obfuscated by an autocorrection algorithm. The de-obfuscated form of the puzzle is its solution. Any of a number of games can then be played where one or more users attempt to solve such puzzles.

19 Claims, 12 Drawing Sheets

700

| *Puzzle (702)* | *Solution (704)* | *Category (706)* | *Difficulty (708)* |
|---|---|---|---|
| $OP_1$ | Solution for $OP_1$ | Phrase | Hard |
| $OP_2$ | Solution for $OP_2$ | Thing | Easy |
| $OP_3$ | Solution for $OP_3$ | Phrase | Medium |

.....

⋮

800

| Word (802) | Obfuscated Word (804) |
|---|---|
| to | yp |
| | tp |
| | ri |

800

| Word (802) | Obfuscated Word (804) |
|---|---|
| or | pr |
| | oe |
| | pt |

800

| Word (802) | Obfuscated Word (804) |
|---|---|
| be | br |
| | bw |
| | nr |

800

| Word (802) | Obfuscated Word (804) |
|---|---|
| not | bot |
| | npy |
| | npt |
| | bor |

Data Base Puzzle Example

| Obfuscated Word | Correct Word |
|---|---|
| COKXSMO | TAKEN |
| REISRER | LASSIE |
| RSKEM | VOLCANO |
| LSAAOE | TWISTER |

Match obfuscated word with correct word.

METHOD AND APPARATUS FOR GAME PLAY INVOLVING PUZZLES WITH AUTOCORRECT-RELATED OBFUSCATION

CROSS-REFERENCE AND PRIORITY CLAIM TO RELATED PATENT APPLICATION

This patent application claims priority to U.S. provisional patent application Ser. No. 61/762,111, filed Feb. 7, 2013, and entitled "Method and Apparatus for Game Play Involving Puzzles with Autocorrect-Related Obfuscation", the entire disclosure of which is incorporated herein by reference.

INTRODUCTION

Many puzzle games are known where users attempt to solve a coded word or phrase. Typically, such puzzles use a simple letter substitution encryption where each letter of a word or phrase is substituted with a replacement letter such that there is a one-to-one correspondence in the mapping between letters and replacement letters (e.g., the letter "r" is used in place of all instances of the letter "a" in the word/phrase, the letter, the letter "d" is used in place of all instances of the letter "b" in the word/phrase, and so on, where each replacement letter will map to only one solution letter). The inventor believes that greater and more interesting opportunities exist for puzzle solving game play that leverage the widespread availability of and knowledge regarding autocorrect software.

Autocorrect software is a well-known tool for text replacement and spelling correction that employs an autocorrection algorithm to process an input string of characters. Autocorrect software is widely deployed in programs such as word processing applications and other data processing applications which involve text input by a user (such as text messaging found on many smart phones, email applications, etc.). In simplistic terms, the software determines whether the input string matches a known word, and if the input string does not match a known word, the software generates a replacement word for the input string. As used herein, the term "autocorrection algorithm" refers to a technique that processes an input string of characters to determine whether a correction to the input string should be generated and presented to a user.

Autocorrect software exists in many forms. For example, some autocorrection algorithms employ an auto-completion feature, whereby the algorithm attempts to predict the word being entered by the user as the user enters characters for the word. Thus, an autocorrection algorithm with an auto-completion feature may automatically present the word "character" to the user after the user has entered the character string "charac". Furthermore, some autocorrection algorithms can automatically replace input strings with replacement strings when deemed appropriate, while other autocorrection algorithms can automatically suggest such replacement strings (with the user thus having the option to accept the suggested replacement). Still other autocorrection algorithms can switch between auto-replace and auto-suggest based on user-selectable configuration settings. Also, some autocorrection algorithms employ a static mapping of input character strings to corrected character strings, while other autocorrection algorithms employ a dynamic adaptive mapping. Such adaptive mappings can be configured to "learn" common misspellings of a user so that they can later be detected and auto-corrected in the future. Further still, it should be understood that an autocorrection algorithm need not maintain a one-to-one correspondence between the number of characters in an input string and a corrected string. For example, with some autocorrection algorithms, it is expected that the input string "reisrer" (7 characters) will map to the corrected string "register" (8 characters). Further still, it should be understood that an autocorrection algorithm can employ multi-word contextual analysis when generating a corrected string. For example, an autocorrection algorithm may be configured to map the input string "reisrer" to either "register" or "twister" depending on context. That is, the corrected string generated by the algorithm for a given input string can vary as a function of other words near the input string under consideration.

The inventor believes that new and unusual games that are engaging and fun can leverage these autocorrection concepts by presenting puzzles for solution to users that effectively employ autocorrection in reverse. In accordance with the invention, a puzzle can comprise a puzzle character string, the puzzle character string comprising one or more obfuscated words, wherein the one or more obfuscated words are configured to be de-obfuscated by an autocorrection algorithm. Such a puzzle is referred to herein as an "obfuscated puzzle". The de-obfuscated form of the puzzle is its solution. Any of a number of games can then be played where one or more users attempt to solve such obfuscated puzzles.

In accordance with exemplary aspects described herein, the inventor discloses a method comprising: (1) providing an obfuscated puzzle to a player, the obfuscated puzzle being associated with a solution, (2) receiving a proposed solution to the obfuscated puzzle from the player, (3) comparing the received proposed solution with the solution associated with the obfuscated puzzle, and (4) in response to the comparison, determining whether the player's proposed solution was correct, and wherein the method steps are performed by a processor. These method steps can be performed with respect to a plurality of players, and a processor can administer a game between the players to reward a player whose proposed solution is determined to be correct. Furthermore, if desired, the method may further comprise a processor (1) receiving a plurality of characters from the player, (2) performing an autocorrection algorithm on the received characters to generate a corrected character string for the received characters, and (3) providing the corrected character string to the player as an option for submission as a proposed solution to the obfuscated puzzle. The inventor also discloses an apparatus and computer program product corresponding to such methods.

In accordance with additional exemplary aspects described herein, the inventor discloses a method comprising: (1) providing a puzzle character string to a player, the puzzle character string comprising one or more obfuscated words, wherein the one or more obfuscated words are configured to be de-obfuscated by an autocorrection algorithm, the puzzle character string having an associated solution, the solution including the de-obfuscated word for each obfuscated word in the puzzle character string, (2) receiving a proposed solution to the puzzle character string from the player, (3) testing the proposed solution for correctness, and (4) in response to the testing indicating that the proposed solution was correct, providing a reward to the player, and wherein the method steps are performed by a processor. The inventor further discloses a corresponding apparatus and computer program product.

Still further, the inventor discloses a method comprising administering a game between a plurality of players where a plurality of obfuscated puzzles are presented to the players, each obfuscated puzzle having an associated solution, wherein the administering step comprises (1) presenting an obfuscated puzzle to the players, the obfuscated puzzle having an associated solution, (2) testing a proposed solution from a player for correctness, (3) in response to the testing, providing a reward to player who provided a proposed solution found to be correct, and (4) repeating the presenting, testing, and reward providing steps for a different obfuscated puzzle as part of the game. The game can comprise a broadcast game show. Also, the administering step can further comprise: (1) providing the players with a computing device, the computing device configured to (i) receive a character string input from a user through a standard keyboard, (ii) perform an autocorrection algorithm on the character string input, and (3) display a corrected character string in response to the performed autocorrection algorithm, and (2) permitting the players to use the computing devices in an attempt to solve the obfuscated puzzles.

Moreover, the inventor discloses a method comprising: (1) receiving a character string input from a user, the character string input to serve as a solution to an obfuscated puzzle, (2) automatically generating an obfuscated puzzle from the received character string input, and (3) creating a data structure that associates the generated obfuscated puzzle with the character string input from which it was generated and which is to serve as its solution, and wherein the method steps are performed by a processor. The automatically generated obfuscated puzzle can then be shared with another user for the another user to attempt solution thereof.

These and other features and advantages of the present invention will be apparent to those having ordinary skill in the art upon review of the teachings in the following description and drawings.

BRIEF DESCRIPTION OF THE DRAWINGS

FIG. 1(*c*) depicts examples of different environments in which an obfuscated puzzle game can be played.

FIG. 4(*b*) depicts an exemplary mobile application arrangement for executing an obfuscated puzzle game.

FIG. 10(*b*) depicts an exemplary user interface screen for the game shown by FIG. 10(*a*).

DETAILED DESCRIPTION

Figure 1A:
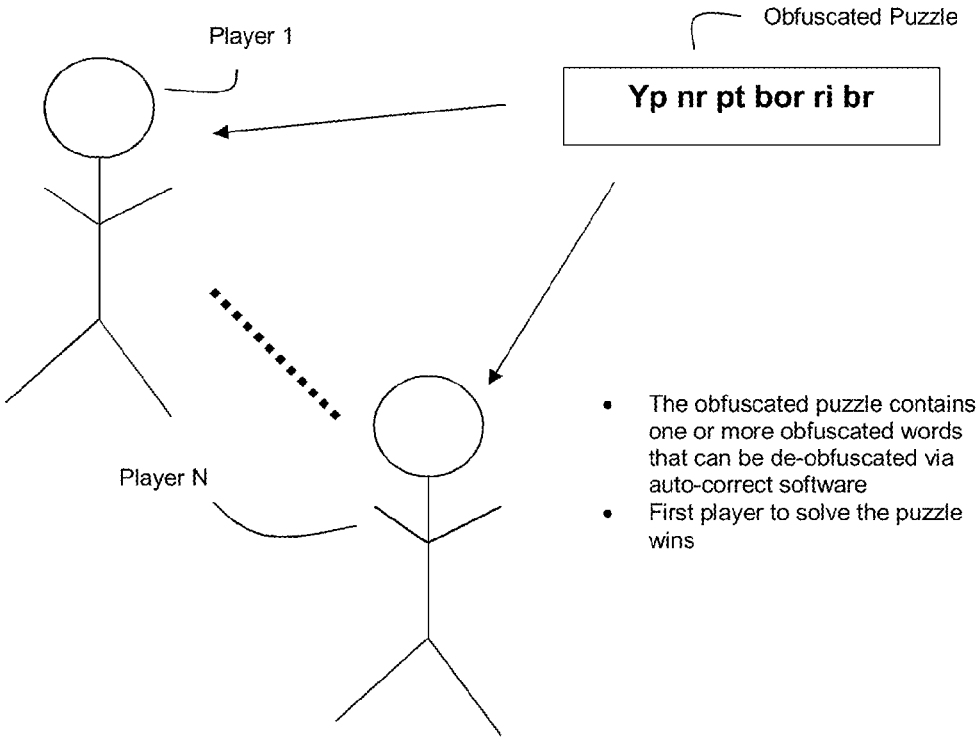
FIGS. 1(*a*) and (*b*) depict an example of how a obfuscated puzzle game can operate.
Figure 1B:
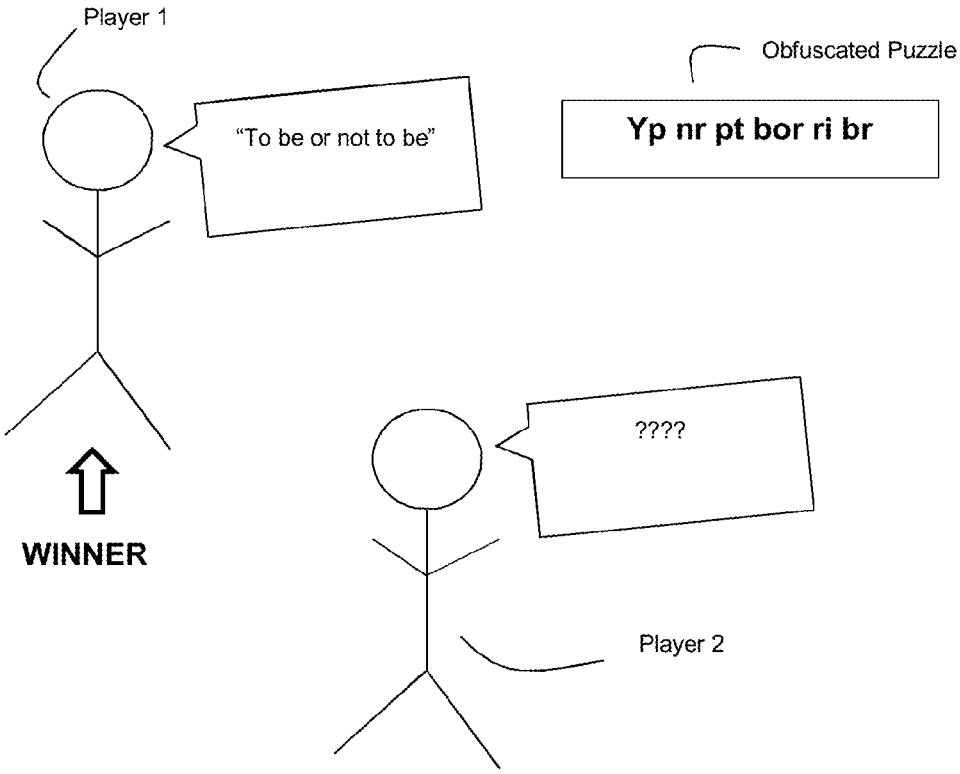
Figure 1C:
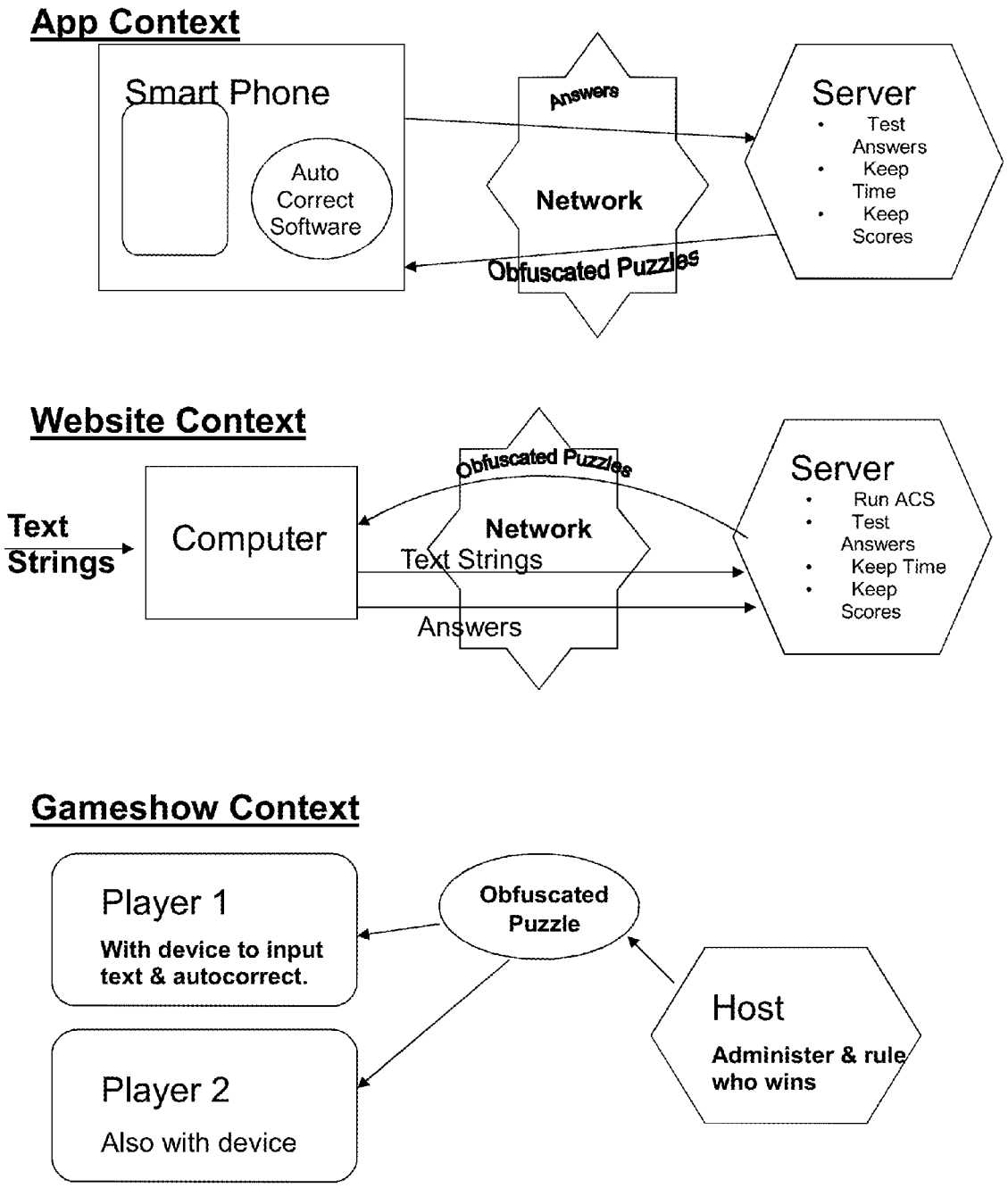

FIG. 1(*a*) depicts an example of how an obfuscated puzzle game can operate. An obfuscated puzzle such as "Yp nr pt bor ri br" can be presented to a plurality of players. One or more words of the obfuscated puzzle are configured for de-obfuscation by an autocorrection algorithm. In the example of FIG. 1(*a*), all of the words of the obfuscated puzzle are obfuscated words. However, it should be understood that this need not be the case. For example, only one word of the obfuscated puzzle need be an obfuscated word that is configured for de-obfuscation by an autocorrection algorithm. Further still, the obfuscated puzzle need not take the form of a multi-word phrase. For example, the obfuscated puzzle can be a single obfuscated word.

In the example of FIG. 1(*a*), the solution for the obfuscated puzzle "Yp nr pt bor ri br" is "To be or not to be". This solution can be ascertained by typing the obfuscated word string "Yp nr pt bor ri br" into a software application configured to execute autocorrect software such that the autocorrect software determines that (1) the word "To" should be used in place of "Yp", (2) the word "be" should be used in place of "nr", (3) the word "or" should be used in place of "Pt", (4) the word "not" should be used in place of "bor", (5) the word "to" should be used in place of "ri", and (6) the word "be" should be used in place of "br".

If Player 1 is the first person to solve the obfuscated puzzle, he or she can be declared the "winner" (see FIG. 1(*b*)). Any of a number of "rules of the game" can be employed by such an obfuscated puzzle game. For example, the obfuscated puzzle can be presented to each player at the same time, and the first player to solve the puzzle can be deemed the winner. As another, example, each player can take turns in attempts to solve the obfuscated puzzle. In yet another example, the players can play asynchronously and where timers are used to track which player is able to solve the obfuscated puzzle in the shortest amount of time. Still further modes of play can be employed.

Furthermore, in an exemplary embodiment, each player can be provided with a computing device, where such computing device is configured with text input capabilities (e.g., a display screen and keyboard, which may take the form of a touchscreen and virtual keyboard displayed on the touchscreen) that are coupled with autocorrect software. In such an embodiment, each player can use the computing device in his/her attempt to solve the obfuscated puzzle.

In another exemplary embodiment, rather than providing each player with access to autocorrect software, each player can be provided with an image of a standard keyboard (e.g., a QWERTY keyboard). The player can then use such an image of the standard keyboard as an aid to solve the obfuscated puzzle. As is well-known, most autocorrection algorithms are premised on the expectation of typographical errors that are a function of the proximity of various letters to each other on the keyboard (e.g., because the letters "u" and "i" are adjacent on a QWERTY keyboard, it can be expected that a typist will often mistakenly type a "u" when an "i" was meant (or vice versa). Thus, by visually presenting how the different letters are arranged on the standard keyboard, the user can assess the appropriateness of possible solutions to the obfuscated puzzle.

The inventor further notes that obfuscated puzzle games can be played in a variety of contexts, as depicted in FIG. 1(*c*). For example, one context can be as a mobile application executed by a portable computing device such as a smart phone as shown in FIG. 1(*c*). With such a context, a server can communicate an obfuscated puzzle to a smart phone over a network, and a mobile application (or "app") is executed by the smart phone to play the game. Autocorrect software resident on the smartphone can optionally be used as an aid for the player to solve the obfuscated puzzle. Answers in the form of proposed solutions can be communicated from the smart phone to the server via the network, and the server can test those answers for correctness, as well as provide additional functionality such as keeping time (e.g., how long did it take the player to solve the puzzle), and keeping score. It should be understood that any of a number of scoring metrics can be used by the game (e.g., awarding a fixed number of points for each correct answer, employing a time reward that provides higher scores for quicker correct answers, etc.).

As another example, a website context can be employed as shown in FIG. 1(*c*). A browser on a player's computer can access a website page for the obfuscated puzzle game on the server via a network such as the Internet. In this example, the autocorrect software can be executed by the server-side rather than the client-side. Thus, as the user inputs text strings through the browser, these text strings can be communicated over the network to the server for processing by the autocorrect software. Any corrected strings from the autocorrect software can be communicated back to the user through the website page. When a proposed solution is sent to the server, the server can process the proposed solution as noted above.

While the exemplary website context shows the autocorrect software being resident on and executed from the server while the exemplary app context shows the autocorrect software being resident on and executed from the smart phone, it should be understood that the server in the app context can execute the autocorrect software and the client computer in the website context can execute the autocorrect software if desired by a practitioner.

As yet another example, a game show context can be employed as shown in FIG. 1(*c*). The game show can be conducted on a broadcast medium such as television, cable, or satellite. A host will present obfuscated puzzles to players for solution. The players will compete with each other to solve the puzzles and accumulate points or prizes. The host and other personnel would then administer the game between the various players. In such a game show context, each player can be provided with (or permitted access to) a computing device that is able to receive and display text entries as well as execute autocorrect software in the course of doing so. The players can then use these computing devices in an attempt to solve the obfuscated puzzle. Alternatively, each player can be provided with (or permitted access to) an image of a standard keyboard as discussed above.

Figure 2:
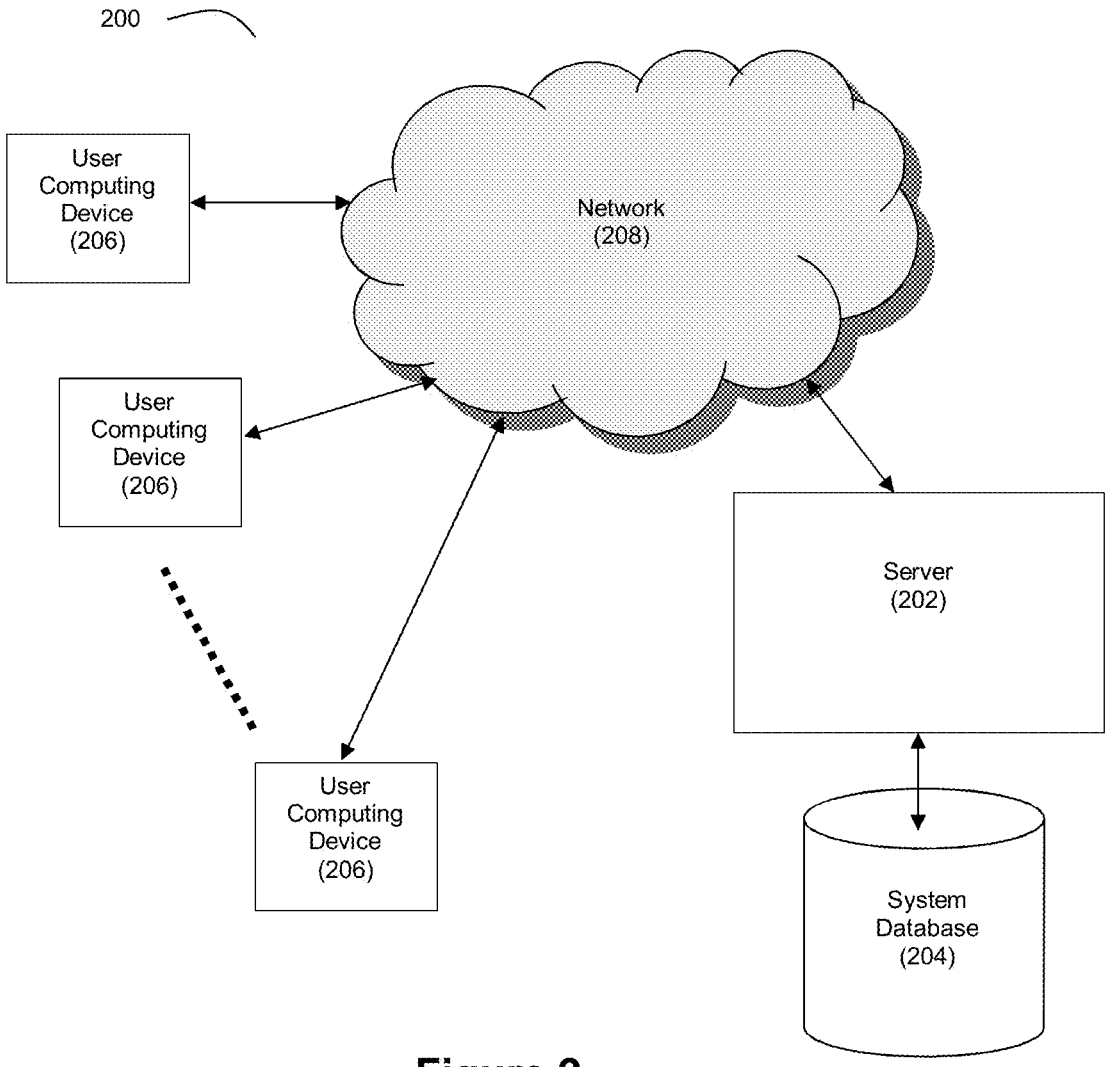
FIG. 2 depicts an exemplary networked computer system configured to execute an obfuscated puzzle game.

FIG. 2 depicts a networked computer system 200 for implementing contexts such as the app context and the website context of FIG. 1(*c*). In the example of FIG. 2, a server 202 is accessible to a plurality of user computing devices 206 via a network 208 such as the Internet.

The server 202 can be configured to access a database 204 in the course of administering game play. It should be understood that the server 202 can comprise a processor and memory that are configured to execute software for administering an obfuscated puzzle game as described herein. The server 202 can comprise one or more servers, as needed by a practitioner of the invention. The database 204 can similarly comprise one or more physical databases, as needed by a practitioner of the invention.

The network 208 can be any data communications network capable of communicating data between the server 202 and a user computing device 206. An example of a suitable network 208 is the Internet. However, it should be understood that the network 208 can comprise a plurality of networks that interconnect to form a larger network, including networks such as cellular data networks and other wireless data networks.

The user computing devices 206 can also take any of a number of forms. Each user computing device 206 can comprise a processor and memory that are configured to execute the game play software as described herein. Examples of suitable user computing devices 206 include standard personal computers (PC) or laptop computers, which can include network connectivity for accessing the server and a browser program for accessing websites. Another example of a suitable user computing device 206 is a mobile computing device such as a smart phone or tablet computer. Still further, the user computing device 206 can take the form of a special purpose device/terminal whose processing capabilities are largely limited to executing the game play described herein.

Figure 3:
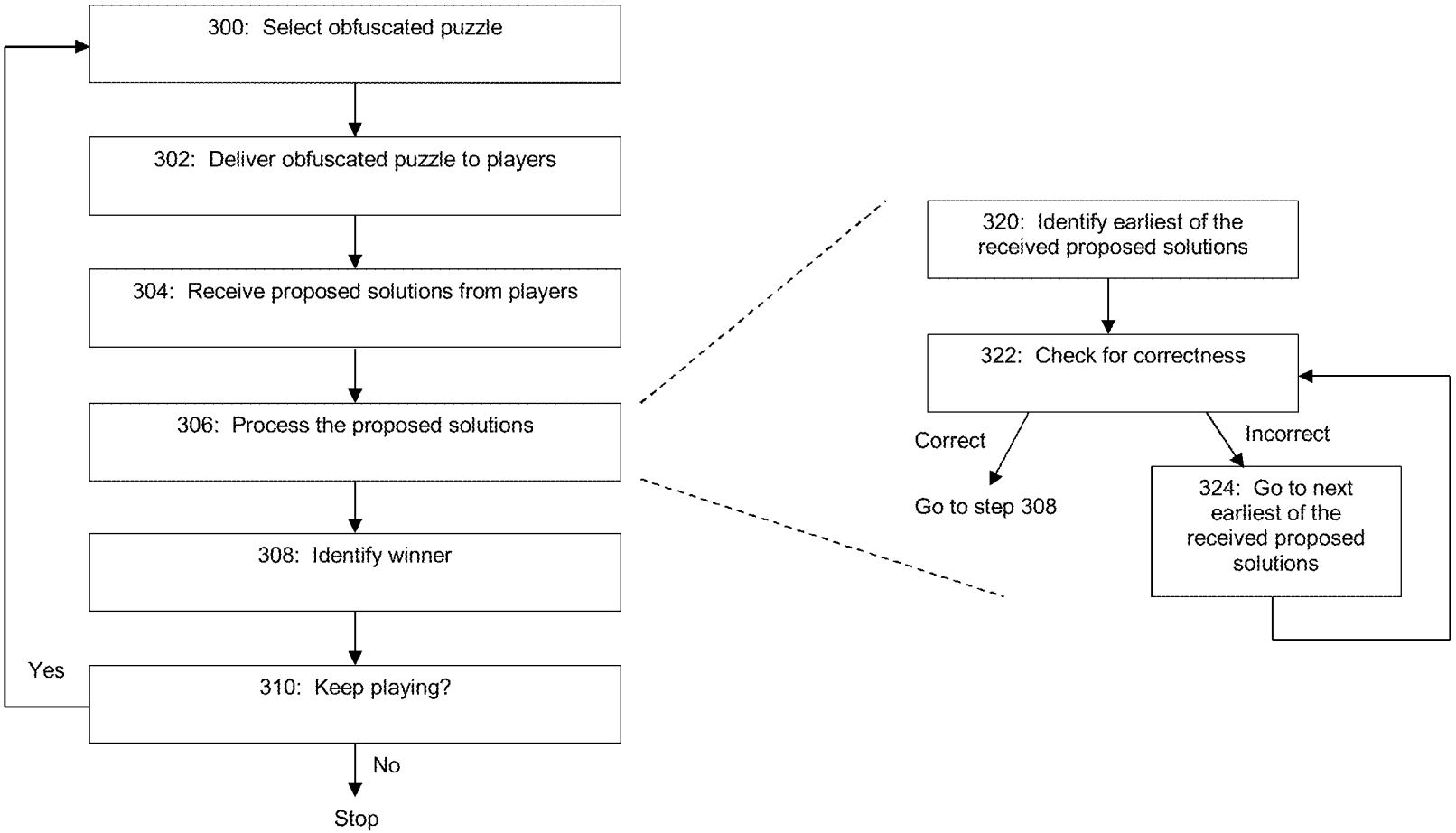
FIG. 3 depicts an exemplary process flow for a processor to execute when administering an obfuscated puzzle game.

FIG. 3 depicts a process flow for execution by a processor (such as a processor resident in server 202) in an exemplary embodiment to administer a multi-player obfuscated puzzle game. At step 300, the processor selects an obfuscated puzzle. A database may store a plurality of obfuscated puzzles, and the processor may employ any of a number of techniques to select which obfuscated puzzle is to be presented to the players. For example, the selection can be a random selection. As another example, if the obfuscated puzzles have an associated categorization relating to degree of difficulty, the processor can be configured to select obfuscated puzzles such that initially an "easy" puzzle is selected, while progressively increasing the degree of difficulty during successive selections. As yet another example, the processor can select an obfuscated puzzle associated with a degree of difficulty desired by the players (e.g., the players indicating that "hard" puzzles are desired).

At step 302, the processor delivers the selected obfuscated puzzle to the players for attempted solution. In a networked embodiment such as that shown by FIG. 2, a server 202 can communicate the selected obfuscated puzzle to a plurality of user computing devices 206 via network 208.

At step 304, the processor receives proposed solutions from the players. In a networked embodiment such as that shown by FIG. 2, the server 202 can receive incoming communications from the user computing devices 206 via the network 208 that include proposed solutions from the players.

At step 306, the processor processes the received proposed solutions, and at step 308, the processor identifies a winner based on the processing at step 306. If the game is to continue (see step 310), then the processor returns to step 300 to select a new obfuscated puzzle. Otherwise, the process flow terminates.

Steps 320-326 elaborate on the processing performed at step 306. At step 320, the processor identifies which of the received proposed solutions is deemed "earliest". The user computing devices 206 can be configured to time stamp the proposed solutions, and the processor can identify the earliest proposed solution on the basis of such time stamps. Similarly, the processor can time stamp its receipt of proposed solutions from the user computing devices 206 and then identify the "earliest" of the received proposed solutions on that basis. At step 322, the processor checks the identified proposed solution for correctness. To do so, the processor can access a data structure in a memory that associates the obfuscated puzzle with its correct solution. If the proposed solution matches the correct solution, then the process flow can proceed to step 308 where the player who first submitted the correct proposed solution is identified as the winner. If the earliest proposed solution is deemed incorrect at step 322, then at step 324, the processor selects the next earliest of the received proposed solutions and returns to step 322. In this fashion, the process flow can reward the player who first solves the obfuscated puzzle.

It should be understood that the process flow of FIG. 3 is exemplary only. For example, the game can be configured to reward all correct answers rather than only the earliest correct answer. In such an embodiment, for example, the players can be provided with a time period in which to solve the obfuscated puzzle (e.g., 60 seconds), and all players who solve the obfuscated puzzle in this time period can be identified as winners. Still other variations are possible.

Furthermore, it should be understood that the same processor need not perform all of the steps in FIG. 3. For example, some of the steps can be performed by a processor resident in a server 202 and some of the steps can be performed by a processor resident in a user computing device 206. Moreover, a process flow similar to that shown by FIG. 3 can be employed to implement a one-player game, in which case the need to intermediate among multiple players is avoided. Further still, for such a one-player game, it should be understood that all of the process flow steps can be performed by a processor resident in a user computing device 206 if desired by a practitioner.

Figure 4A:
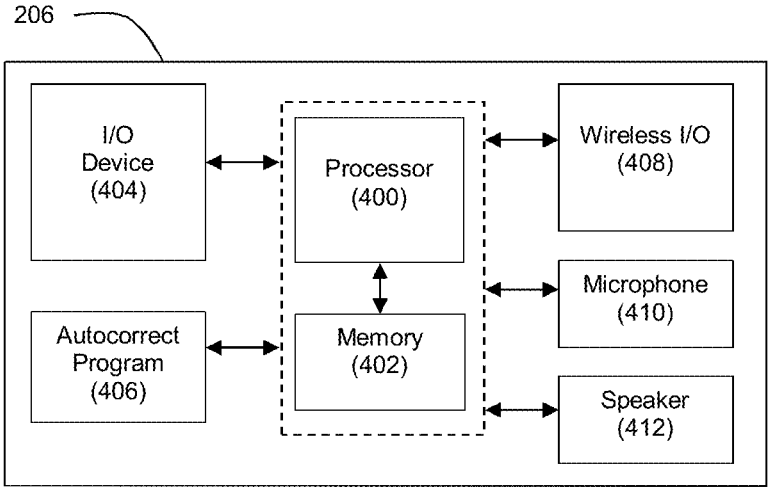
FIG. 4(*a*) depicts an exemplary portable computing device on which an obfuscated puzzle game can be played.
Figure 4B:
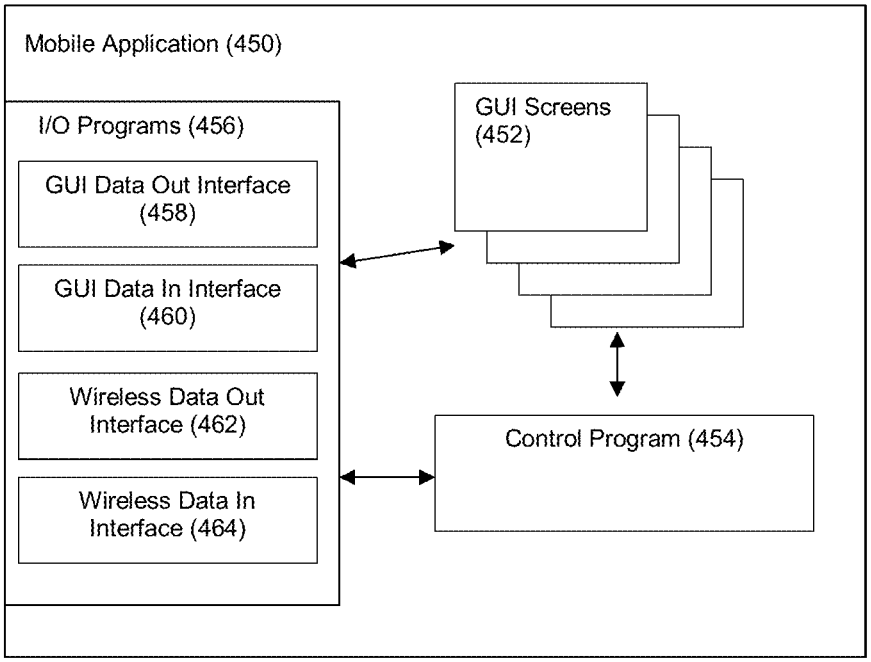

FIG. 4(*a*) depicts an exemplary user computing device 206 on which an obfuscated puzzle game can be played. In the example of FIG. 4(*a*), the user computing device can be a mobile computing device. The mobile computing device can be a smart phone (e.g., an iPhone, a Google Android device, a Blackberry device, etc.), tablet computer (e.g., an iPad), or the like. The mobile computing device preferably employs a touchscreen or the like for interacting with a user. However, it should be understood that any of a variety of data display techniques and data input techniques could be employed by the mobile computing device. For example, to receive inputs from a user, the mobile computing device need not necessarily employ a touchscreen—it could also or alternatively employ a keyboard or other mechanisms such as voice capture-to-text translation. The mobile computing device 206 shown by FIG. 4(*a*) may comprise a processor 400 and associated memory 402, where the processor 400 and memory 402 are configured to cooperate to execute software and/or firmware that supports operation of the mobile computing device 206. Furthermore, the mobile computing device 206 may include an I/O device 404 (e.g., a touchscreen user interface for graphically displaying output data and receiving input data from a user), wireless I/O 408 for sending and receiving data, a microphone 410 for sensing sound and converting the sensed sound into an electrical signal for processing by the mobile computing device 206, and a speaker 412 for converting sound data into audible sound. The wireless I/O 408 may include capabilities for making and taking telephone calls, communicating with nearby objects via near field communication (NFC), communicating with nearby objects via radio frequency (RF), and/or communicating with nearby objects via BlueTooth. The mobile computing device may also include features such as a camera, a GPS positioning system, etc. These components are now resident in many standard models of smart phones and other mobile computing devices.

FIG. 4(*a*) also shows an autocorrect program 406 that is resident on the mobile computing device 206. Such an autocorrect program 406 can be loaded into memory 402 for execution by the processor 400. An autocorrect program 406 is another standard pre-existing or legacy feature on most models of smart phones and other mobile computing devices. Execution of the autocorrect program 406 will cause an autocorrection algorithm to be applied to character inputs by a user through the I/O device 404. Thus, when the user enters a character string such as "cokxsmo" into an email or a text message through the mobile computing device, the autocorrect program 406 can be executed by the processor 400 to identify "volcano" as a corrected string for "cokxsmo". As previously discussed, the autocorrect program 406 can be configured to implement any of a number of different types of autocorrection algorithms.

A mobile application 450 (or "app") executed by the mobile computing device can operate as the medium through which a user plays an obfuscated puzzle game. FIG. 4(*b*) depicts an exemplary mobile application 450 for an exemplary embodiment. Mobile application 450 can be installed on the mobile computing device for execution by processor 400. The mobile application 450 preferably comprises a plurality of computer-executable instructions resident on a non-transitory computer-readable storage medium such as a computer memory. The instructions may include instructions defining a plurality of graphical user interface (GUI) screens for presentation to the user through the I/O device 404. The instructions may also include instructions defining various I/O programs 456 such as:

- a GUI data out interface 458 for interfacing with the I/O device 404 to present one or more GUI screens 452 to the user;
- a GUI data in interface 460 for interfacing with the I/O device 404 to receive user input data therefrom;
- a wireless data out interface 462 for interfacing with the wireless I/O 408 to provide the wireless I/O with data for communication over the network (e.g., to send proposed solutions to an obfuscated puzzle to a server); and
- a wireless data in interface 464 for interfacing with the wireless I/O 408 to receive data communicated over the network to the mobile device for processing by the mobile application 450 (e.g., to receive obfuscated puzzles from a server for use in a game).

The instructions may further include instructions defining a control program 454. The control program 454 can be configured to provide the primary intelligence for the mobile application 450, including orchestrating the data outgoing to and incoming from the I/O programs 456 (e.g., determining which GUI screens 452 are to be presented to the user).

If desired by a practitioner, the mobile application 450 can be configured to provide autocorrect functionality to users. For example, the I/O programs 456 can include an interface to the mobile computing device's resident autocorrect program 406. Through this interface, character strings input by a user through the mobile application 450 can be passed to the autocorrect program 406 for processing and suggested corrected string can be passed back to the mobile application 450 from the autocorrect program 406. As another example, the control program 454 can include its own autocorrect program for execution by the mobile application 450.

Figure 5A:
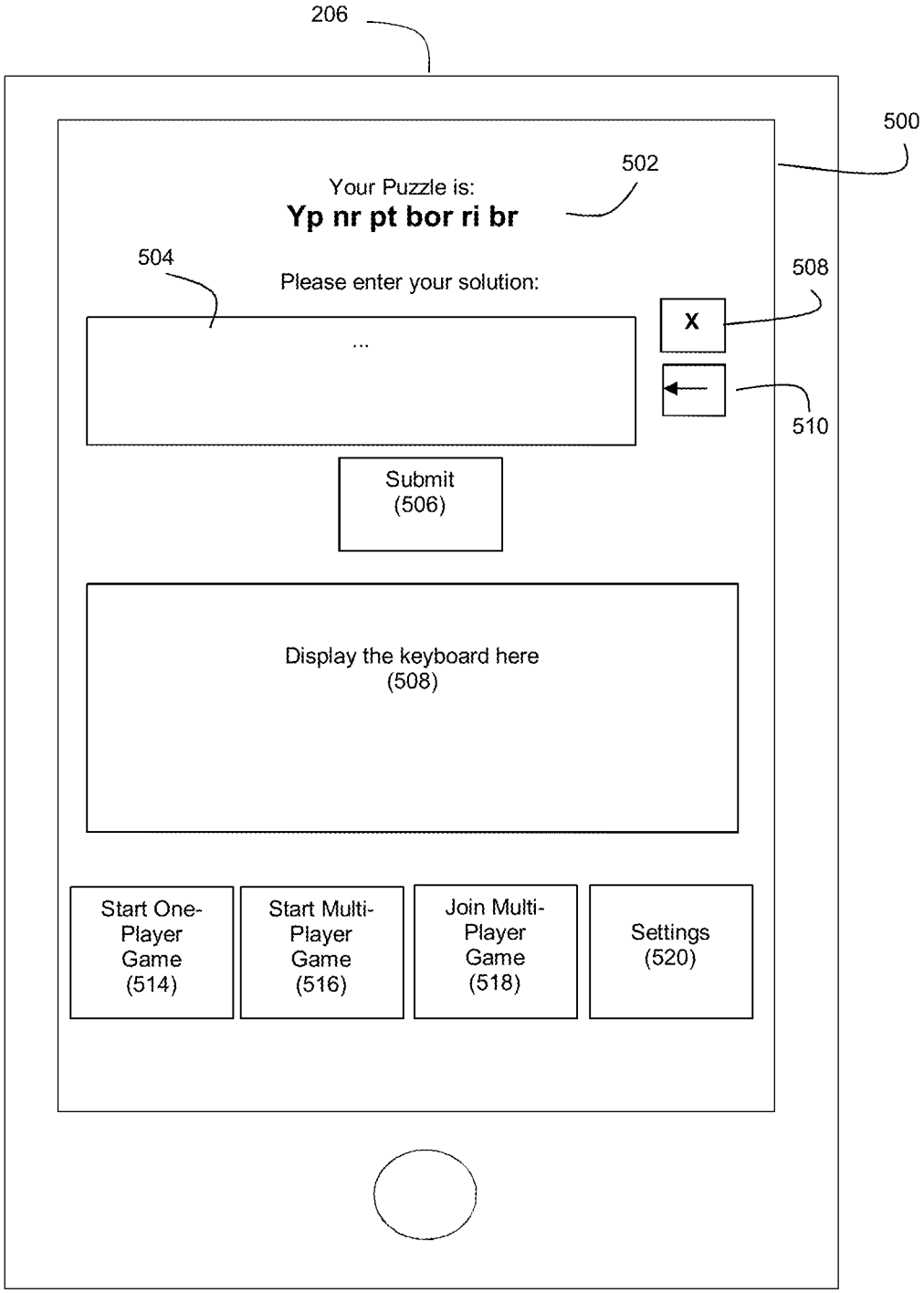
FIGS. 5(*a*) and (*b*) depict exemplary user interface screens for an obfuscated puzzle game.
Figure 5B:
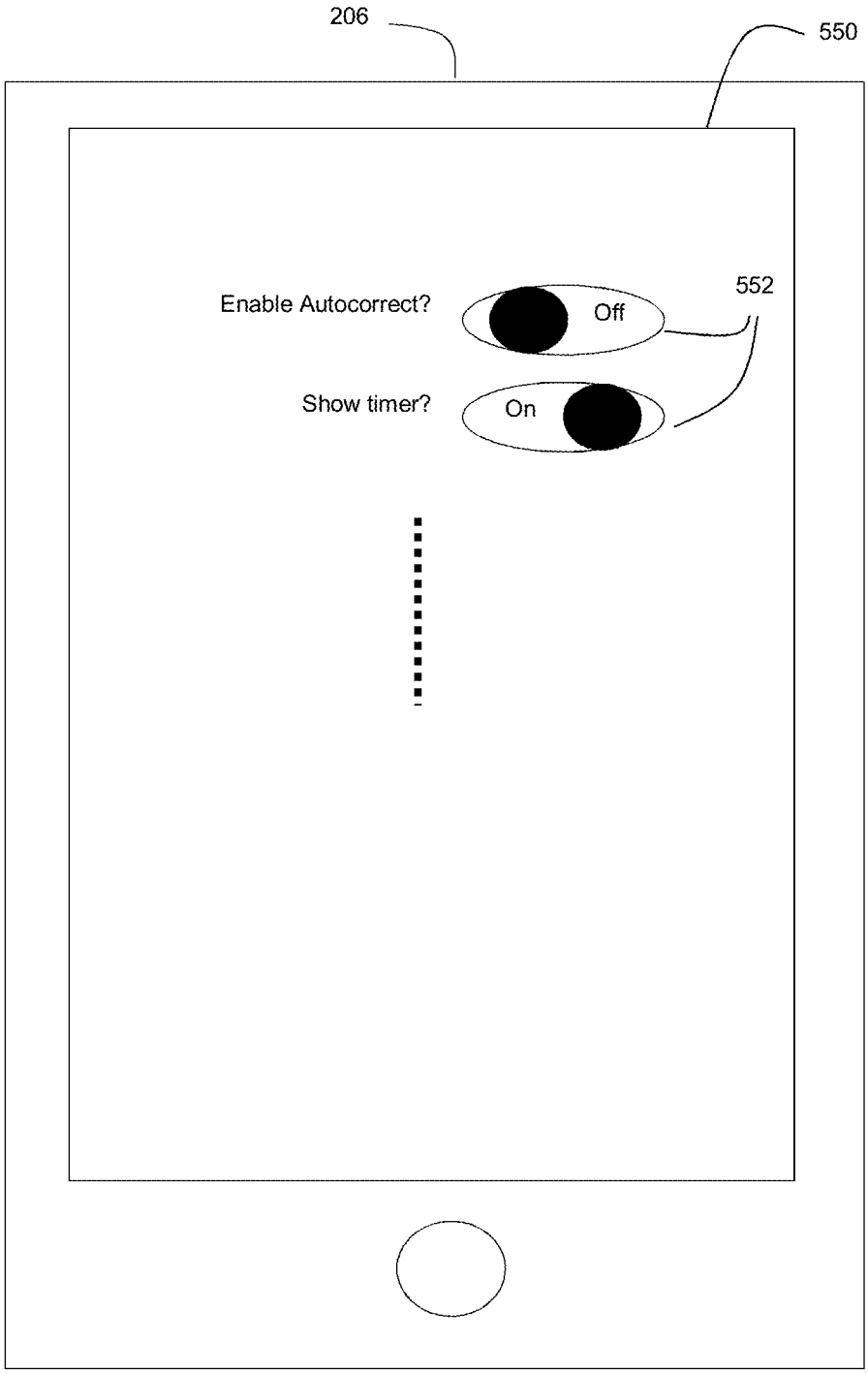

FIG. 5(*a*) depicts an exemplary GUI screen 500 for display on a mobile computing device 206 in connection with mobile application 450. The GUI screen 500 includes a portion 502 that displays an obfuscated puzzle to the user. The GUI screen 500 also includes a character entry user input portion 504, where the character entry user input portion 504 is configured to receive an input of characters from the user that represent the user's proposed solution to the obfuscated puzzle shown in portion 502. A virtual touchscreen-based keyboard 508 can also be displayed as part of the GUI screen 500. Keyboard 508 is preferably a standard layout keyboard such as a QWERTY keyboard. User selection of characters on keyboard 508 will cause a character string to be generated in portion 504. Once a user has created a character string in portion 504 that the user believes is a solution to the obfuscated puzzle, the user can select the "submit" button 506 to test the proposed solution for correctness. If the user wants to edit the character string that he or she has entered in portion 504, the editing buttons 508 and 510 (delete/start over and backspace, respectively) can be selected.

The GUI screen 500 can also include additional user-selectable buttons relating to game play. For example, a button 514 can be included that is user-selectable to initiate a new one-player obfuscated puzzle game. A button 516 can be included that is user-selectable to initiate a new multi-player obfuscated puzzle game. Upon selection of button 516, the server can be accessed to arrange an obfuscated puzzle game among a plurality of users of the user computing devices 206. A button 518 can also be included that is user-selectable to join an existing multi-player game (similar in effect to button 516, but where a user joins a networked game that may already be in progress). A button 520 can be included that is user-selectable to access another GUI screen through which the user can adjust the settings for an obfuscated puzzle game.

Still other configurations for the GUI screen 500 can be employed. For example, the GUI screen 500 can include a timer that identifies an amount of time in relation to the user's attempt to solve the puzzle (e.g., a countdown clock or a count-up clock). Such a time can be configured to begin when a user first starts entering text via the keyboard 508 or within a set amount of time from when the obfuscated puzzle is first presented to the user in portion 502. Furthermore, additional user-selectable buttons can be provided that correspond to things such as "How to Play", "Rules", "Choose Category" (if multiple categories of obfuscated puzzles or game play are available), "Backup" or "Previous", "Undo", "Play with a Friend"; "Start" (with respect to a timer, if a timer is employed), "Hint"; "Resume Game"; "Pause"; "Single words" (if the user has the option of attempting to solve an obfuscated puzzle that is a single word), and "Phrases" (if the user has the option of attempting to solve an obfuscated puzzle that is an obfuscated phrase). With a "Play with a Friend" option, the mobile application can be configured for integration with a social network such as Facebook or the like, whereby people who are "friends" of the user can access and play the obfuscated puzzle game with the user through their social network account.

FIG. 5(*b*) depicts an exemplary GUI screen 550 for a user to control the settings for the obfuscation puzzle game. The exemplary GUI screen 550 can include user-configurable settings 552 for parameters such as whether the autocorrect features are enabled and whether a timer is shown to the user. A slider bar or other user input mechanism can be provided for the user to define such settings. If the user chooses to enable the autocorrect feature, then an autocorrect program will execute while the user inputs characters into portion 504 of GUI screen 500 so as to suggest corrected versions of the user's input characters. Thus, if the user were to type in the obfuscated puzzle, it may very well be the case that the autocorrect feature will reveal the solution to the puzzle. However, depending on how a practitioner implements the system, this is not guaranteed, as explained below. If the user chooses to disable the autocorrect feature, then the autocorrect program will not execute, and the user will have to rely on his or her own intuitions to solve the obfuscated puzzle. In this regard, the user can leverage the keyboard display 508 of GUI screen 500 to guess how the obfuscated puzzle may translate to its solution by noting which letters are proximate to the letters of the puzzle on keyboard 508. It should be understood that the settings options shown in FIG. 5(*b*) are exemplary only, and a practitioner may choose to include more, fewer, and/or different settings options for different embodiments.

Figures 6, 7:
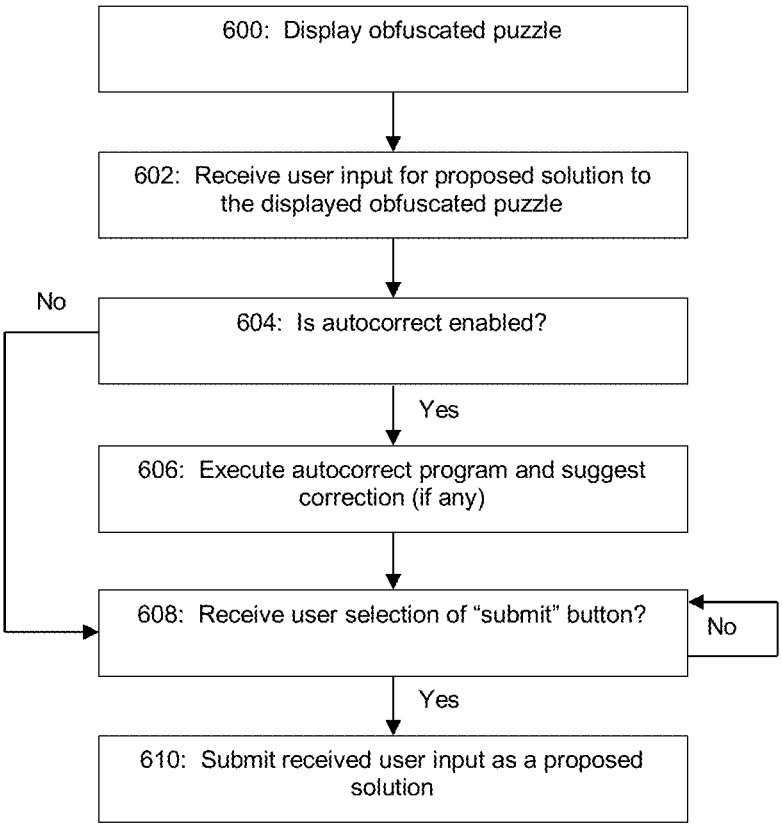
FIG. 6 depicts an exemplary process flow for a user computing device to execute when an obfuscated puzzle game is played by a user.
FIG. 7 depicts an exemplary data structure whereby obfuscated puzzles are associated with their corresponding solutions.

FIG. 6 depicts an exemplary process flow for execution by a processor such as processor 400 to implement obfuscated puzzle game play by a user computing device 206. For example, the process flow of FIG. 6 can be embodied by control program 454. At step 600, the obfuscated puzzle is displayed (see portion 502 of GUI screen 500). At step 602, the processor receives user input for a proposed solution to the displayed obfuscation puzzle. This input will take the form of a series of characters entered by the user (e.g., via keyboard 508 of GUI screen 500). At step 604, the processor checks whether the autocorrect feature is enabled.

If the autocorrect feature is enabled, then at step 606, the processor executes the autocorrect program as the user enters characters at step 602. If the autocorrect program determines that a corrected character string should be presented to the user, the correction is so presented to the user. Furthermore, it is expected that the autocorrect program will be configured to update its correction suggestions as the user enters additional input characters. From step 606, the process flow proceeds to step 608. At step 608, the processor awaits user selection of the "submit" button 506 or the like. Upon selection of the "submit" button, the processor submits the user input (possibly auto-corrected) as a proposed solution. In a networked embodiment, this may involve communicating the proposed solution to the server via a network. In an embodiment where proposed solutions are tested locally, this may involve initiating a comparison between the proposed solution and the correct solution.

If the autocorrect feature is disabled, then the process flow proceeds from step 604 to step 608, bypassing step 606. Thus, with the autocorrect feature disabled, the user is expected to rely on his or her own knowledge to solve the obfuscated puzzle.

It should be understood that additional tasks can be performed by control program 454 in connection with obfuscated puzzle game play. For example, the control program can provide different modes of game play (one player versus multi-player, different types of obfuscated puzzles, different manners of scoring or tracking winners, etc.). As an example, a game play mode can be configured to track how fast a player can correctly solve an obfuscated puzzle (or a series of obfuscated puzzles). In such an arrangement, the mobile application can track the user's best time and compare each game's solution time against this best time, an average best time for other players, or the best time for all other players. As another example, if the autocorrect features are enabled, a game play mode can be configured where the object of the game is to solve the obfuscated puzzle before the autocorrect feature has revealed the solution in full. Furthermore, in such an arrangement, the user could be awarded a progressively higher score for solving the puzzle as a function of a lesser reveal by the autocorrect program (for example, if the user solves the puzzle after the autocorrect program reveals the de-obfuscated first word of the puzzle, then the user would get a higher score than if the puzzle was solved after the autocorrect program had revealed two de-obfuscated words of the puzzle).

FIG. 7 depicts an exemplary data structure 700 that can be leveraged by a processor when implementing an obfuscated puzzle game. The data structure 700 can be stored in a memory, and it is configured to associate obfuscated puzzles (see column 702) with their solutions (see column 704). The data structure 700 can take any of a number of forms, such as relational data in a database, an XML data structure, or other forms. Furthermore, the data structure can be resident in a server 202 (or database 204 accessible to server 202), a user computing device 206, and/or elsewhere in a location that is accessible to either or both of the server and user computing device. If the data structure 700 is resident solely on the server-side of the network 208, then it is expected that the user computing devices 206 will need to communicate proposed solutions to the server 202 to test those proposed solutions for correctness. If the data structure is resident on the user computing devices 206, it is expected that the user computing devices 206 will be able to locally test whether a proposed solution is correct.

The data structure 700 may also be optionally configured to associate obfuscated puzzles with additional information such as a category (see column 706), a difficulty (see column 708), etc. Such additional information can then be used when selecting which obfuscated puzzles should be presented to a user. Exemplary categories can include classifications such as phrase, thing, song title, place, etc. It should be understood that other items of additional information can also be associated with obfuscated puzzles, such as language (if the system supports game play in multiple languages), a version of an autocorrect program (if obfuscation is tied to a particular version of an autocorrect program), a keyboard version (if the obfuscation is tied to a specific keyboard layout (e.g., a QWERTY keyboard or a keyboard arrangement where a given key may correspondence to multiple characters (as is found on some models of smart phones), etc.).

Figures 8, 9:
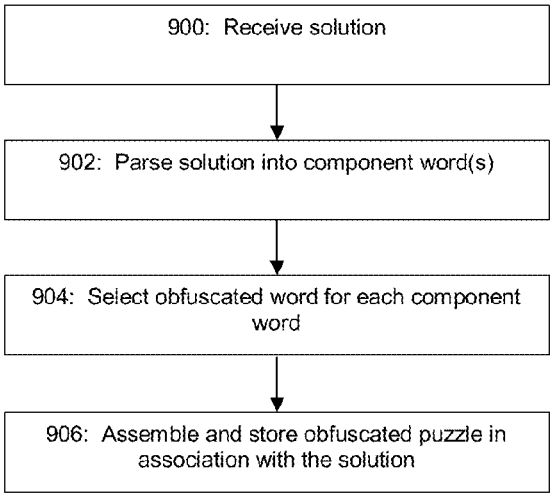
FIG. 8 depicts exemplary data structures whereby words are associated with obfuscated versions of those words, wherein the obfuscated word versions are configured to be de-obfuscated by an autocorrection algorithm.
FIG. 9 depicts an exemplary process flow for execution to generate an obfuscated puzzle from a solution.

FIG. 8 depicts exemplary data structures 800 that can be employed to associate words with one or more corresponding obfuscations of those words, where the obfuscated words are configured to de-obfuscate by an autocorrection algorithm. The data structures 800 can be stored in a memory, and they can serve as building blocks for multi-word obfuscated puzzles. Each data structure may comprise a word (see column 802) and its associated obfuscated word (see column 804). Given that a plurality of different obfuscated words may map to a word, each word in column 802 may be associated with one or more obfuscated words in column 804. Moreover, it should be understood that the same obfuscated word may be associated with a plurality of different words in columns 802. For example, as noted above, the obfuscated word "reisrer" can be associated with the word "register" and the word "twister". As with data structure 700, the data structures 800 can take any of a number of forms, such as relational data in a database, an XML data structure, or other forms, and the data structures 800 can be resident in a server 202 (or database 204 accessible to server 202), a user computing device 206, and/or elsewhere in a location that is accessible to either or both of the server and user computing device. Further still, each data structure 800 may optionally be configured to associate words with one or more items of additional information if desired by a practitioner. For example, each obfuscated word in column 802 can be associated with a difficulty parameter. In such an instance, the difficulty of resolving obfuscated word "tp" to the word "to" can be assigned a lower difficulty than for resolving the obfuscated word "yp" to the word "to" (given that in the "yp" situation, neither of the letters of the obfuscated word are present in the corrected word, while in the "tp" situation, there is only one letter's worth of obfuscation). A memory can be configured to store data structures 800 for a large number of words, including a full dictionary of words if desired by a practitioner.

FIG. 9 depicts an exemplary process flow for execution by a processor to generate an obfuscated puzzle from a solution using the data structures 800. At step 900, the solution is received (e.g., the phrase "To be or not to be" could be received as a solution). As an example, the solution can be received at step 900 as an input from a user.

At step 902, the solution is parsed into its component word(s). For example, the phrase "To be or not to be" can be parsed into the individual words "to", "be", "or", "not", "to" and "be".

At step 904, the processor selects an obfuscated word for each component word that was parsed at step 902. To do so, the processor can access the data structures 800 to identify the data structure 800 corresponding to the word under consideration. If only one obfuscated word is associated with the word under consideration, then that obfuscated word can be selected at step 904. If a plurality of obfuscated words are associated with the word under consideration, then an algorithm of some sort can be employed to make the selection. For example, a randomization algorithm can be employed to randomly select an obfuscated word from among the choices. Alternatively, a round robin-type algorithm can be employed where the first time a selection is made with respect to a word, the first associated obfuscated word is selected while the second time a selection is made with respect to that word, the second associated obfuscated word is selected, and so on. Still other selection mechanisms can be employed. For example, if obfuscated words are associated in the data structures 800 with a difficulty parameter, and if the process flow of FIG. 9 is being executed to generate an obfuscated puzzle with a defined degree of difficulty, then the difficulty associations in the data structures 800 can be employed to make a selection.

After the processor has selected an obfuscated word for each of the component words at step 904, the processor can assemble the obfuscated puzzle at step 906 from the selected obfuscated words. The processor can also store this obfuscated puzzle in a data structure 700 in association with its solution. In such a manner, the obfuscated puzzle would then be ready for use during game play.

If desired by a practitioner, the process flow of FIG. 9 can be executed by server 202 or other computer with access to database 204. A practitioner can also choose to have a processor resident on a user computing device 206 execute the process flow of FIG. 9 if desired.

Depending on the mode of game play desired by a practitioner, it should be understood that by building obfuscated puzzles on a word-by-word basis as described in connection with FIG. 9, the resultant obfuscated puzzle may not be directly resolvable by simply typing the full obfuscated puzzle in an input field for processing by an autocorrect program. In such instances, it is expected that this nuance will enhance the interestingness of the game to a user. That is, typing the full obfuscated puzzle may not result in the autocorrect program yielding the correct solution, particularly in game play modes where the solution is to be a well-known phrase or other particular phrase. The reasons for this can be numerous. For example, some autocorrect programs are context-sensitive. Thus, if the obfuscated puzzle is a phrase with multiple words, other words in the puzzle may cause the autocorrect program to map a character string to the wrong word (relative to the solution). As another example, because the same obfuscated word may map to multiple corrected words (e.g., the "reisrer" example previously used above), there is no guarantee that the autocorrected word will be the correct word for the solution. As still another example, because many autocorrect programs are adaptive, previous text entries by a user (via the mobile application 450 or other applications on the computing device) may cause a user's particular version of an autocorrect program to behave differently than the autocorrection algorithm that is relevant to de-obfuscating the obfuscated puzzle. Once again, such a variety in autocorrect programs can enhance the interestingness of game play. However, if a practitioner wishes to minimize the effect of adaptive autocorrect programs, the practitioner can configure the mobile application 450 to access a standardized and static autocorrect program such that all users leverage the same autocorrect functionality.

Figure 10A:
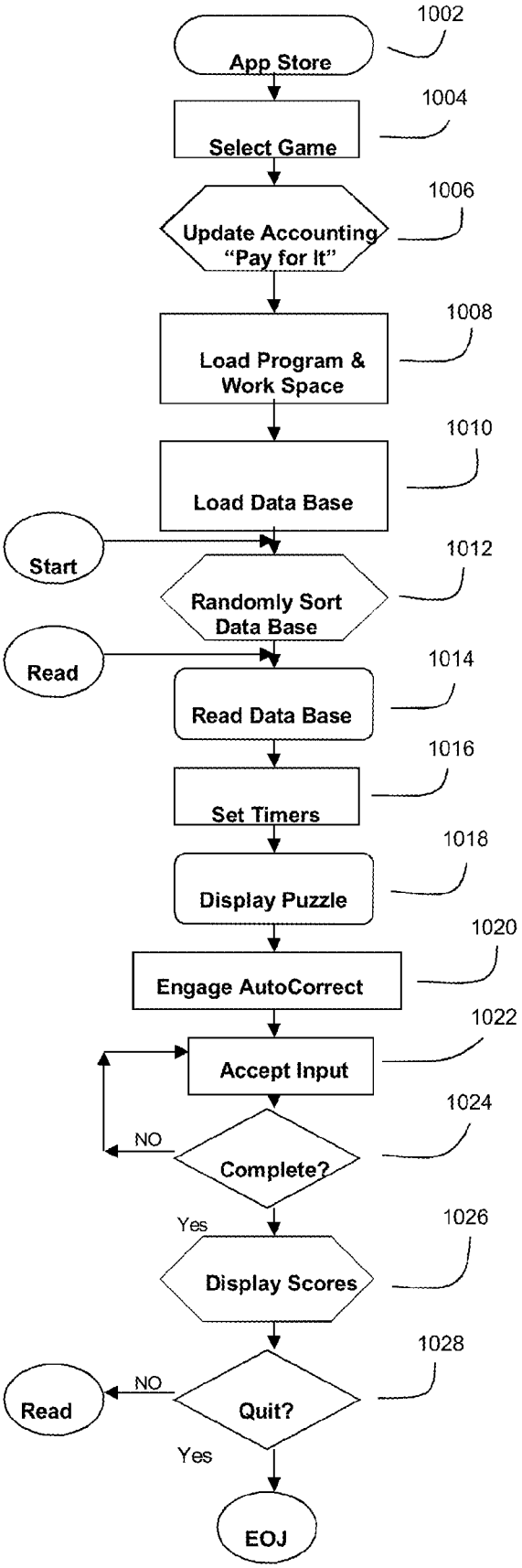
FIG. 10(*a*) depicts an exemplary process flow for an embodiment whereby an obfuscated puzzle game is deployed as a smart phone "app".
Figure 10B:
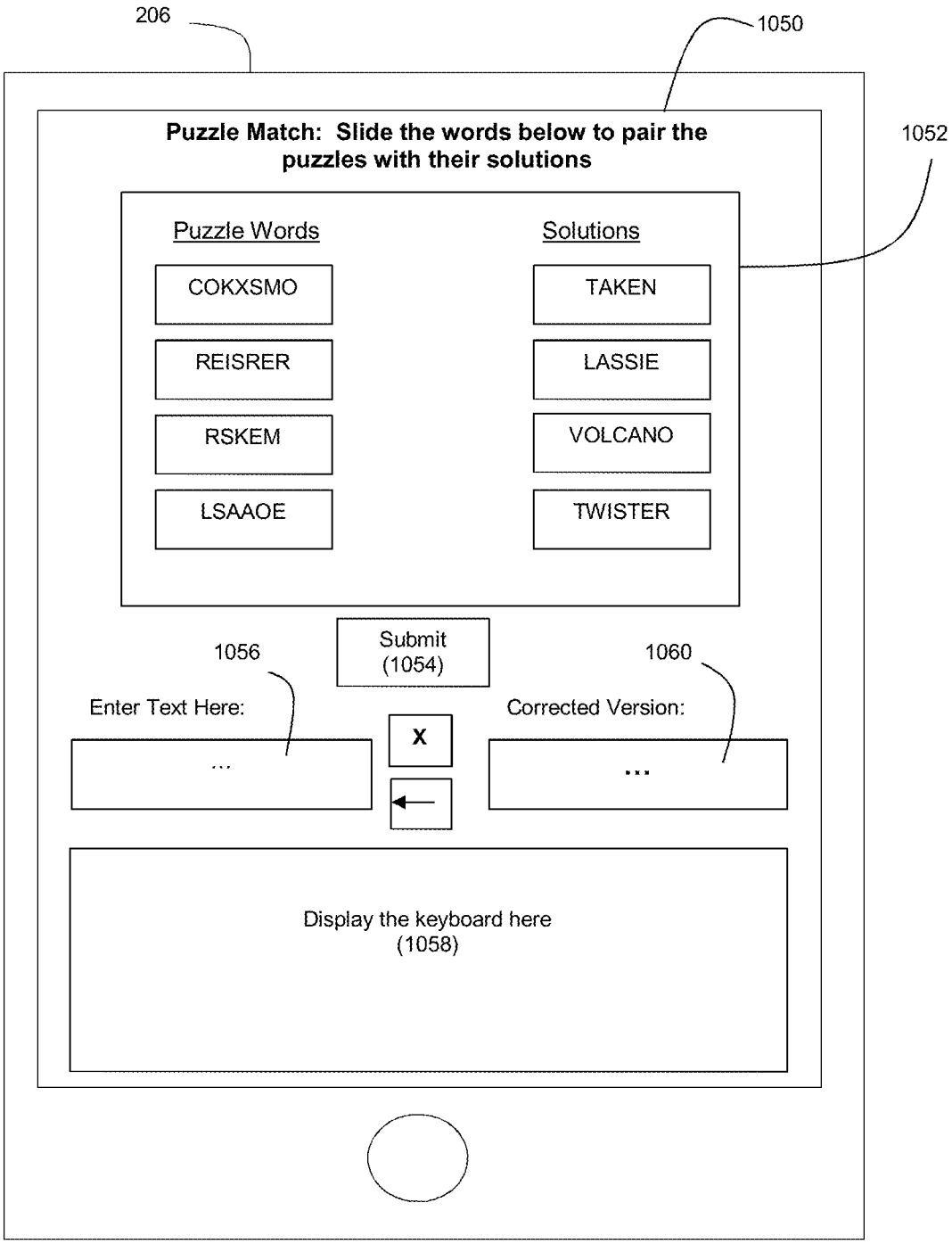

FIG. 10(*a*) depicts another exemplary process flow for an embodiment whereby an obfuscated puzzle game is deployed as a smart phone "app". A mobile application 450 that embodies the game is available for download from an app store 1002, such as the app store available from Apple. At step 1004, the game app is selected, and at step 1006 it is paid for. The app 450 is then downloaded into a smart phone and loaded into the workspace of the smart phone's processor for execution (step 1008). A database (such as a database for data structure 700 and optionally data structures 800) can also be loaded into the smart phone for the app (step 1010).

To start play, the app can randomly sort the database (step 1012) and read the sorted database (step 1014) to identify an obfuscated puzzle for presentation to the user. A timer can be initialized (step 1016), and the obfuscated puzzle is presented to the user (step 1018). FIG. 10(*a*) shows an example of an obfuscated puzzle that can be selected from the database. This example of a puzzle presents 4 obfuscated words in one column and presents 4 corrected words in another column. The object of the puzzle game is for the user to match the obfuscated words with their correct word counterparts in as little time as possible. In this example, "cokxsmo" should be matched to "volcano", "reisrer" should be matched to "twister", "rskem" should be matched to "taken", and "lsaaoe" should be matched to "lassie". The GUI screen can also be configured to provide a text entry field for the user to enter character strings corresponding to the obfuscated words. The autocorrect program can then operate at step 1020 to suggest corrections to the obfuscations. From such corrections (or the user's own intuitions), the user can attempt to match obfuscated words to correct words at step 1022. For example, the GUI screen can be configured to permit the user to drag an obfuscated word to a correct word to create a pairing or vice versa.

At step 1024, the process flow can check whether the user has completed the puzzle. If the puzzle is successfully completed, points can be awarded to the user (e.g., in an amount that is a function of how long it took the user to solve the puzzle), and a score can be displayed (step 1026). At step 1028, the process flow determines whether to quit the game (e.g., in response to user input) or whether to continue with a new puzzle from the database.

FIG. 10(*b*) depicts an exemplary GUI screen 1050 that is configured to support game play for an obfuscated puzzle such as that shown in FIG. 10(*a*). The GUI screen 1050 can include a portion 1052 where the different obfuscated words are shown in one column and their corresponding solutions are shown in another column, but where each row in which an obfuscated puzzle resides does not necessarily contain that puzzle's corresponding solution. Thus, the player will need to match each obfuscated word in one column with its solution in the other column as part of the game. To facilitate such matching, portion 1052 can be configured to be responsive to touch input to drag an obfuscated puzzle word toward any of the solution words (or vice versa) to create a pairing. When the user has finished pairing his/her guesses in such a fashion, the user can select the "submit" button 1054 to test his/her proposed solutions.

As an aid to solution, the GUI screen 1050 can be configured to include a text entry portion 1056 in which a user enters text via a keyboard 1058. The autocorrect program can operate on the characters shown in portion 1056 to generate a corrected word for display in portion 1060. Thus, by entering the obfuscated words in portion 1056 via the keyboard 1058, a user can be alerted as to possible solutions to the puzzle.

Figure 11:
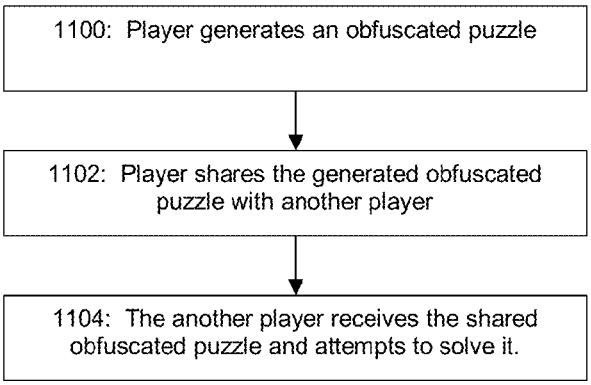
FIG. 11 depicts an exemplary process flow for an embodiment whereby a user generates an obfuscated puzzles for sharing with another user.
Figure 12:
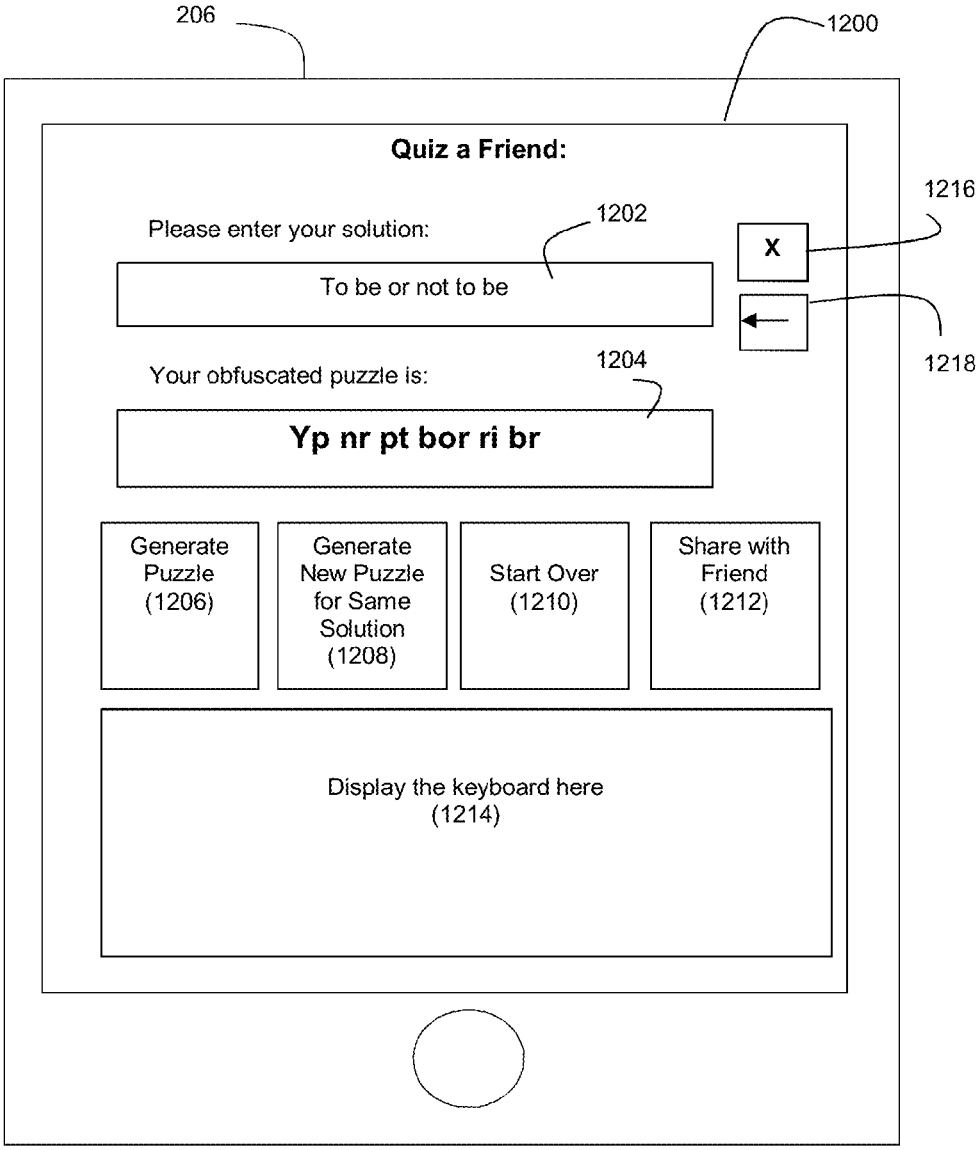
FIG. 12 depicts an exemplary user interface screen for the sharing embodiment of FIG. 11.

FIG. 11 depicts an exemplary process flow for execution by a processor for another exemplary embodiment. In the embodiment of FIG. 11, users are able to generate obfuscated puzzles for sharing with other users. A mobile application 450 for execution by a smart phone or the like can be configured to implement the process flow of FIG. 11. At step 1100, a player generates an obfuscated puzzle. The technique described in connection with FIGS. 8 and 9 can be executed to generate such obfuscated puzzles in response to user input. For example, as shown in FIG. 12, a GUI screen 1200 can be configured to solicit an input of a solution from a user in text entry portion 1202. The user can enter the solution in portion 1202 via keyboard 1214. Delete button 1216 and backspace button 1218 can be used to edit any text entered by the user in portion 1202. In response to the selection of button 1206, the process flow of FIG. 9 can be executed in conjunction with data structures 800 to generate an obfuscated puzzle from the solution. Portion 1204 of the GUI screen 1200 can be configured to display this generated obfuscated puzzle.

If the user believes the generated obfuscated puzzle shown in portion 1204 serves as a good puzzle for sharing with one or more other users, the user can select button 1212 to initiate execution of step 1102 in FIG. 11. At step 1102, the generated obfuscated puzzle is shared with one or more other users. For example, upon selection of button 1212, the user can be prompted to identify the one or more other users with whom the generated obfuscated puzzle is to be shared (for example, by entering user identifiers for such other users). If the system is configured to maintain a social network among users such that some users are deemed "friends" of each other, a GUI screen can be displayed that identifies the user's "friends" for selection with regard to sharing. The user computing device 206 can then communicate the generated obfuscated puzzle to the server 202 along with an identification of the user(s) with whom the generated obfuscated puzzle is to be shared. The server 202 can then deliver the shared puzzle to user computing devices associated with the identified user(s).

Upon receipt of the shared puzzle (step 1104), the other user(s) can then attempt to solve the shared obfuscated puzzle using techniques such as those described in connection with FIGS. 5(*a*) and 6. It is believed that such as "quiz a friend" feature may provide a fun and thought-provoking way of different players to challenge each other to solve obfuscated puzzles. A scoring system can be instituted between such players to track who is able to more quickly and/or effectively solve each other's puzzles.

Returning to FIG. 12, it should be noted that the GUI screen 1200 can also be configured with a button 1208 that is operative upon user selection to cause the process flow of FIG. 9 to be re-executed to generate a new obfuscated puzzle for the same solution that was entered into portion 1202. As noted in connection with FIGS. 8 and 9, in instances where a word in a solution maps to multiple obfuscated words, different executions of the FIG. 9 process flow can result in different obfuscated puzzles being generated for the same solution. Thus, through the use of button 1208, a user can attempt to generate a puzzle deemed particularly challenging if desired. Furthermore, if the user decides that a different solution should be used, button 1210 can be selected to fully remove the text entered in portion 1202 so the user can start over with a new solution (similar in function to button 1216).

It should be understood that the examples described herein for obfuscated puzzle games are exemplary only. Any of a number of different ways of playing an obfuscated puzzle game can be implemented. For example, if a player wants to guess single words the app screen can be configured to show a list of correctly spelled words (and where each word can be constrained to include at least a defined number of letters (e.g., 5 letters)) on one portion of the screen and the reverse-autocorrect obfuscations of those words on another portion of the screen (see, for example, FIG. 10(*b*)). The player can either guess which correct words correspond to which obfuscated words without inputting letters or by inputting letters one at a time to see what the word might be before the autocorrect software fully corrects the word from the input letters. The object of such a game would be to match the correct words with their corresponding obfuscated words before the autocorrect software does it for you. If the autocorrect software does give you the word before you guess it, it will remove that word in the choices list. If the player can guess the word before inputting all the letters, he/she can touch the screen to show his/her choice which will stop the clock and notify the player if the answer is correct or not. Higher scores can be awarded for solving the puzzles using fewer input letters for processing by the autocorrect software.

Moreover, if a player wants to try for a group of words as in a saying or quote, each word would not need to be more than 5 letters. If the player can guess the answer before inputting all the words, he/she can stop the timer by touching the screen to choose one of three options shown. The player with the highest score, earned by having the correct answers in the quickest time, wins the round/phase or game.

Also, to elaborate on the game show context described above in connection with FIG. 1(*c*), it should be understood that a number of different game show embodiments are possible for obfuscated puzzle games. For example, a plurality of different players (e.g., three players) will be playing against each other at the start of the game. The game show can proceed in a number of phases or rounds that are designed to eliminate a player until only one player remains, at which time that remaining player can try for the win. Each player would be given or read the rules of the game, and will sign an agreement to play by the rules prior to airing.

The host of the game show will describe the basic rules and how to play the game at the beginning of each show for the audience's (studio and home) benefit to follow/play along.

For game play, each player can be given an identical hand-held computing device (e.g., a smart phone or dedicated terminal that is able to execute an autocorrect program). Each instance of the autocorrect program can be identical such that it will produce the same results for the same inputs, although that need not be the case. For example, to introduce chance and variety, the players can be given access to computing devices with different versions of autocorrect programs, and a mechanism can be implemented for deciding how the different computing devices are distributed among the players (e.g., random chance, a lead-in puzzle, a trivia question, etc.). The host will announce and show the category that the solutions will fit into, such as movie titles, song lyrics, famous people, famous phrases, etc. Each play and phase of the game will be timed.

The obfuscated puzzle will be shown to each player, studio member and home audience at the same time. The players can be permitted to use the computing devices to enter the obfuscated puzzle in an attempt for the autocorrect program to generate the solution. With each letter typed in, there is a possibility that the autocorrect program may yield the solution even if the player has not yet typed in all of the letters of the obfuscated puzzle. The players will compete to be the first to correctly guess the solution to the obfuscated puzzle.

At a first phase/round of the game, each player can be given the same obfuscated puzzles that correspond to short phrases of 5 to 10 obfuscated words. Each player will input the letters shown to come up with the correct words in the phrase (through operation of the autocorrect program). Although the players are not timed during this first phase, a player may guess the correct phrase before having entered all the letters of the obfuscated puzzle if he/she thinks he/she knows the solution. At that time, such a player will stop the clock to say or guess the solution. If the solution is incorrect, play continues with the next short phrase and no one wins points/money for that first obfuscated puzzle. This phase of the game would continue for a predetermined amount of time, or number of rounds. At the conclusion of the first phase, the lowest scoring player would be eliminated from the competition, and the game continues to a second round/phase.

The second phase/round of the game can be a lightning round. The remaining players are shown a plurality of obfuscated puzzles (e.g., 10 puzzles), where each obfuscated puzzle consists of a single obfuscated word. For challenge, it would be preferred that each obfuscated word have at least 5 characters. Once again, the remaining players will have access to the computing devices to leverage an autocorrect program to arrive at solutions. The players can be shown all of the obfuscated puzzles at the same time, and they will have a limited amount of time (e.g., a 30 second or 60 second countdown clock) to come up with solutions to all of the obfuscated puzzles. If one of the players is the first to correctly guess all solutions prior to the clock running out, that player would be the winner for the round. If time runs out and no one has yet correctly provided all solutions, then whoever has the most number of correct solutions would win the round. If they have the same number of correct solutions, then a one-puzzle tie-breaker can be used to identify the winner. The player who has the highest score from the two combined phases/rounds at the end of the lightning round would then go on to play the final round alone for an opportunity to win additional rewards.

The third and final phase/round has only one player. In this phase, the player is given an obfuscated puzzle corresponding to a phrase that comprises 15 to 20 obfuscated words chosen from a category that will be announced prior to play. The player must come up with the correct solution within a defined time period (e.g., 30 seconds). The player can guess the solution without having to input each character of the puzzle into the computing device for autocorrection if he/she thinks he/she knows the answer. But, it would probably be wise for the player to finish the 30 seconds to make sure that he/she maximizes his/her chance for success.

To increase the challenge, a practitioner could choose to limit how the autocorrect program is used during the final round (or any round for that matter). For example, the computing device can be configured to only permit a limited number of characters (less than all of the characters of the obfuscated puzzle) to be entered into the computing device for autocorrection (e.g., a 10 or 15 character limit). In that way, the player would be forced to focus his/her autocorrection efforts on obfuscated words of the puzzle that may possibly yield clues as to the other components of the phrase. Similar limitations could be enforced during earlier rounds of game play.

While FIG. 1(*c*) describes three different contexts for obfuscated puzzle game play, it should be understood that still other contexts are possible. For example, a board game could be used as the platform through which the obfuscated puzzle game is played. The board game can include a playing surface (e.g., a foldable board) with indicia printed thereon for guiding game play. A set of cards that include obfuscated puzzles and their solutions can be included, as can a set of dice or other chance resolving means to further guide game play (e.g., a spinner, an electronic number generator, etc.). The printed indicia can include markers for items such as a start position and finish position. The indicia can further include a number of spaces between start and finish. The game can be configured where each player begins at the start position and the first player to reach the finish position wins. Players can advance by correctly solving an obfuscated puzzle that is printed on a card. The cards can also include the solution for the obfuscated puzzle. A dice or other chance resolving means can be used to identify how far each player travels during a turn. Each player can be given one puzzle per turn or be permitted to maintain their turn so long as correct solutions to obfuscated puzzles are given. Optionally, a timer can be provided to limit an amount of time that a player has to guess a solution. Furthermore, each player can optionally be permitted to solve an obfuscated puzzle using a computing device configured with an autocorrect program as previously described. The computing device(s) can either be included with the game, or the players can be required to bring their own.

While the present invention has been described above in relation to exemplary embodiments, various modifications may be made thereto that still fall within the invention's scope, as would be recognized by those of ordinary skill in the art. Such modifications to the invention will be recognizable upon review of the teachings herein. As such, the full scope of the present invention is to be defined solely by the appended claims and their legal equivalents.

What is claimed is:

1. A method comprising:

maintaining a plurality of data structures in a memory that provide autocorrection in reverse with respect to a plurality of words, each data structure comprising a word and at least one obfuscated word associated with that word, each obfuscated word configured for de-obfuscation into its associated word by performing an autocorrection algorithm on the obfuscated word;

selecting an obfuscated word from the data structures, wherein the selected obfuscated word is to serve as an obfuscated puzzle, wherein the word that is associated with the selected obfuscated word is to serve as a solution for the obfuscated puzzle;

providing the obfuscated puzzle to a player;

receiving a proposed solution to the obfuscated puzzle from the player;

comparing the received proposed solution with the solution for the obfuscated puzzle; and in response to the comparison, determining whether the player's proposed solution was correct; and wherein the method steps are performed by a processor.

2. The method of claim 1 further comprising:

performing the method steps with respect to a plurality of players; and a processor administering a game between the players to reward a player whose proposed solution is determined to be correct.

3. The method of claim 1 wherein the processor is resident on a smart phone.

4. The method of claim 1 wherein the processor is resident on a server, wherein the providing step comprises the server communicating, via a network, the obfuscated puzzle to a user computing device associated with the player for display thereon, and wherein the receiving step comprises the server receiving, via a network, the proposed solution from the user computing device associated with the player.

5. The method of claim 1 wherein the processor comprises a first processor and a second processor, the first processor performing the providing step, and the second processor performing the receiving, comparing, and determining steps.

6. The method of claim 1 further comprising:

the processor providing the player with an option to process an input character string using an autocorrect program to formulate at least a portion of a possible solution to the obfuscated puzzle.

7. The method of claim 6 further comprising:

the processor defining a user-configurable setting for enabling or disabling the autocorrect program option.

8. The method of claim 1 further comprising:

the processor (1) receiving a plurality of characters from the player, (2) performing an autocorrection algorithm on the received characters to generate a corrected character string for the received characters, and (3) providing the corrected character string to the player as an option for submission as a proposed solution to the obfuscated puzzle.

9. The method of claim 1 further comprising:

the processor providing an image of a standardized keyboard to the player for use by the player when attempting to solve the obfuscated puzzle.

10. The method of claim 1 wherein the comparing step comprises the processor (1) accessing a data structure stored in a memory, the data structure comprising data representative of the obfuscated puzzle in association with data representative of the solution for the obfuscated puzzle, and (2) comparing the received proposed solution with the data representative of the solution from the accessed data structure.

11. The method of claim 1 wherein the obfuscated puzzle comprises a plurality of obfuscated words.

12. A method comprising:

maintaining a plurality of data structures in a memory that provide autocorrection in reverse with respect to a plurality of words, each data structure comprising a word and at least one obfuscated word associated with that word, each obfuscated word configured for de-obfuscation into its associated word by performing an autocorrection algorithm on the obfuscated word;

selecting a plurality of obfuscated word from the data structures, wherein the selected obfuscated words are to serve as a puzzle character string, wherein the words that are associated with the selected obfuscated words are to serve as a solution for the puzzle character string;

providing the puzzle character string to a player;

receiving a proposed solution to the puzzle character string from the player;

testing the proposed solution for correctness; and in response to the testing indicating that the proposed solution was correct, providing a reward to the player; and wherein the method steps are performed by a processor.

13. The method of claim 12 further comprising:

performing the method steps with respect to a plurality of players; and the processor administering a game between the players to reward a player whose proposed solution is found to be correct.

14. The method of claim 12 further comprising:

the processor providing the player with an option to process an input character string using an autocorrect program to formulate at least a portion of a possible solution to the obfuscated puzzle.

15. The method of claim 12 wherein the proposed solution receiving step comprises:

the processor receiving a character string input from the player;

the processor performing an autocorrection algorithm on the received character string to generate a corrected character string in response to the received character string;

the processor receiving input from the player that is indicative of using the corrected character string as at least a portion of the proposed solution.

16. The method of claim 15 further comprising the processor imposing a limit on how much of the puzzle character string can be processed by the autocorrection algorithm such that less than all of the characters of the puzzle input character string can be so processed.

17. A method comprising:

the processor maintaining a plurality of data structures in a memory, each data structure comprising a word and at least one obfuscated word associated with that word, each obfuscated word configured for de-obfuscation into its associated word by performing an autocorrection algorithm on the obfuscated word;

receiving a character string input from a user, the character string input to serve as a solution to an obfuscated puzzle;

automatically generating an obfuscated puzzle from the received character string input, wherein the generated obfuscated puzzle is based on autocorrection in reverse such that the obfuscated puzzle is configured to be de-obfuscated into its solution via an autocorrection algorithm, wherein the automatically generating step comprises:

the processor parsing the character string input into each component word of the character input string;

for each component word, the processor accessing the memory to identify an obfuscated word associated with that component word; and the processor assembling the obfuscated puzzle from each identified obfuscated word; and creating a data structure that associates the generated obfuscated puzzle with the character string input from which it was generated and which is to serve as its solution; and wherein the method steps are performed by a processor.

18. The method of claim 17 further comprising:

sharing the generated obfuscated puzzle with another user for the another user to attempt solution thereof.

19. The method of claim 18 further comprising:

the processor presenting the automatically generated obfuscated puzzle to the user;

the processor providing a user-selectable button on a graphical user interface (GUI) screen presented to the user;

the processor receiving input indicative of user selection of the button; and in response to the received input that is indicative of user selection of the button, the processor repeating the automatically generating step to automatically generate a different obfuscated puzzle for the same character input string.

* * * * *